US011953297B2

(12) United States Patent
Clanton et al.

(10) Patent No.: US 11,953,297 B2
(45) Date of Patent: Apr. 9, 2024

(54) PORTABLE FLAMETHROWER

(71) Applicant: DP & LC Holdings, LLC, North Palm Beach, FL (US)

(72) Inventors: Lewis Clanton, Fort Pierce, FL (US); Donald Patnaude, North Palm Beach, FL (US); Chris Byars, Apache Junction, AZ (US)

(73) Assignee: DP & LC HOLDINGS, LLC, North Palm Beach, FL (US)

( * ) Notice: Subject to any disclaimer, the term of this patent is extended or adjusted under 35 U.S.C. 154(b) by 537 days.

(21) Appl. No.: 17/188,368

(22) Filed: Mar. 1, 2021

(65) Prior Publication Data

US 2021/0278177 A1 Sep. 9, 2021

Related U.S. Application Data

(60) Provisional application No. 63/014,411, filed on Apr. 23, 2020.

(51) Int. Cl.
*F41H 9/02* (2006.01)

(52) U.S. Cl.
CPC ..... *F41H 9/02* (2013.01)

(58) Field of Classification Search
CPC ..... F41H 9/02
USPC ..... 431/91, 127–128, 142
See application file for complete search history.

(56) References Cited

U.S. PATENT DOCUMENTS 1,304,710 A 5/1919 Seidler
1,797,654 A 3/1931 Grund
2,331,388 A 10/1943 Graham
2,417,981 A 3/1947 Graham
2,548,196 A * 4/1951 Clark ..... A01M 15/00 239/525
2,601,893 A 7/1952 Funke
2,631,581 A 3/1953 Skousgaard
2,889,652 A 6/1959 Hartshorn
2,937,698 A 5/1960 Greenlee
2,943,673 A 7/1960 Hickman
2,971,573 A 2/1961 Griffin et al.
3,034,568 A 5/1962 Fowler et al.
3,038,530 A 6/1962 Fowler
(Continued)

FOREIGN PATENT DOCUMENTS

AU 197943612 8/1979
CA 627930 9/1961
(Continued)

OTHER PUBLICATIONS

United States Department of AgricultureSpark—Ignited Utility—Terrain Vehicle Torch Operations Manual, Dec. 2019.†
(Continued)

*Primary Examiner* — Vivek K Shirsat
(74) *Attorney, Agent, or Firm* — McHale & Slavin, P.A.

(57) ABSTRACT

A portable flamethrower is provided. It includes a fuel supply, including an externally powered fuel pump in flow communication with a nozzle and a fuel tank. An ignition system is provided to effect igniting of a stream of liquid fuel. An electronic control system is provided to effect selective operation of the ignition system and the fuel system, and preclude their operation if operation criteria are not met.

16 Claims, 9 Drawing Sheets

(56) References Cited

U.S. PATENT DOCUMENTS

| | | | | |
|---|---|---|---|---|
| 3,106,238 | A | 10/1963 | Bruce | |
| 3,164,927 | A | 1/1965 | Holloway | |
| 3,197,070 | A | 7/1965 | Pearl et al. | |
| 3,335,780 | A | 8/1967 | Klaubert | |
| 3,634,157 | A | 1/1972 | Batson | |
| 3,639,108 | A | 2/1972 | Finkelstein et al. | |
| 3,872,769 | A | 3/1975 | Rosling | |
| 3,880,569 | A | 4/1975 | Bannister et al. | |
| 4,395,227 | A | 7/1983 | Stivers | |
| 8,834,152 | B1 * | 9/2014 | Calvert | F41C 27/00 431/91 |
| 2004/0076915 | A1 | 4/2004 | Holler | |
| 2010/0263524 | A1 * | 10/2010 | Morin | F42D 5/04 901/1 |
| 2021/0318104 | A1 * | 10/2021 | Gore | F41H 9/02 |

FOREIGN PATENT DOCUMENTS

| | | |
|---|---|---|
| CA | 660535 | 4/1963 |
| DE | 202006003848 | 7/2006 |
| FR | 2651862 | 3/1991 |
| FR | 2759452 | 8/1998 |
| GB | 572854 | 10/1945 |
| GB | 572855 | 10/1945 |
| GB | 601309 | 5/1948 |
| GB | 869261 | 5/1961 |
| GB | 878007 | 9/1961 |
| JP | H07260111 | 10/1995 |
| JP | 2005207664 | 8/2005 |
| WO | WO2009127784 | 10/2009 |

OTHER PUBLICATIONS

Throwflame—Introducing the TF-19 Flamethrower Drone, video published on https://www.youtube.com/watch?v=07rtBip9ixk, Jul. 16, 2019.†

Vulcan Flamethrowers—Operation Manual, 2016.†

Throwflame Web page < https://throwflame.com/products/flamethrower-drone-kit/>, Sep. 1, 2019, retrieved from Internet Archive Wayback Machine on Jun. 13, 2022.†

* cited by examiner
† cited by third party

PORTABLE FLAMETHROWER

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 63/014,411, entitled "PORTABLE FLAME THROWER", filed Apr. 23, 2020. The contents of the above referenced application are incorporated herein by reference in its entirety.

FIELD OF THE INVENTION

The present invention relates to portable flamethrowers using a liquid fuel to selectively create an ignitable stream emanating from a nozzle.

BACKGROUND OF THE INVENTION

Flamethrowers are well known in the art. They are configured to be used in various forms. One form is for military use and can be portable, i.e., can be carried and used by a single person or can be vehicle mounted. During WWII, tank-like vehicles were constructed to function as flamethrowers to provide extended range of the flame and to provide safety for the operator. Flamethrowers are used by government people to create fires in fire prevention endeavors, such as controlled burns. Some units are constructed for individual use to burn yard weeds and the like. Some are configured for use by individuals to simulate military use. They can be used for agriculture, snow and ice removal, weed control, insect control, forestry, special effects and land management.

Some flamethrowers are designed to use a gelled fuel which can burn in transit to a target; and unburned fuel can stick to the target and continue to burn. The burning rate of gelled fuel can be slower than a liquid fuel. Another form of flamethrower can use liquid fuels. Typical fuels are, or include, hydrocarbons. Examples of such fuels include gasoline, diesel fuel, kerosene, alcohol, and blends of different fuel types and the like. There is literature that mentions dry powdered fuel.

DESCRIPTION OF THE PRIOR ART

Typical flamethrowers utilize a tank for fuel storage and a tank for a compressed gas that is used to impart energy to a fuel stream to propel the fuel from a nozzle for burning downstream of a nozzle. While effective, pumping up a tank of gas is time consuming and requires work input by a person. This may require stoppage of use of the device for extended periods while the device is pressurized since some of these pump-up types of flamethrowers use pressure on the order of 300-400 psi as an initial pressure. As the pressure declines with use, the effective range of the device declines.

U.S. Pat. No. 2,331,388 discloses a vehicle mounted flamethrower that utilizes a pump powered by the engine of the vehicle. However, this device provides no portability.

U.S. Pat. No. 8,834,152 discloses a firearm mounted flamethrower. The flamethrower utilizes radio frequency to start operation of fluid dispersal. The firearm holder can then fire the weapon to ignite the fuel. The unreliability of the radio frequency operation and ignition from the muzzle blast makes this system impractical for use.

Other types of structures are provided to provide the pressure to propel a stream of combustible fuel from a flamethrower nozzle. Some flamethrowers use a pilot flame to ignite the fuel stream and some utilize electronic ignition. There is also a flamethrower that is mounted to a drone, but it is not designed for carrying by a person.

A review of the art indicates there is little attention, if any, paid to operational safety and user convenience. Therefore, there exists a need in the art for more portable flamethrower devices.

SUMMARY OF THE INVENTION

The present invention provides a portable flamethrower for both work use and for individual personal use. It includes a fuel supply, having an externally powered fuel pump in flow communication with a nozzle and a fuel tank. An ignition system is provided to effect igniting of a stream of liquid fuel. An electronic control system is provided to effect selective operation of the ignition system and the fuel system, and preclude their operation if operation criteria are not met. A rechargeable battery (or batteries) is provided to power the electronics, the fuel pump and the ignition system.

Accordingly, it is a primary objective of the present invention to provide a flamethrower with improved safety during operation.

It is a further objective of the present invention to provide a flamethrower with improved operational characteristics.

It is yet another objective of the present invention that the flamethrower can be configured as a free standing portable flamethrower or configured as an accessory for attachment to a firearm while still portable.

It is still yet another objective of the present invention to provide a flamethrower with easily obtainable replacement components to ensure long useful life of the flamethrower.

It is yet another objective of the present invention to provide a flamethrower with safety elements to help reduce the risk of accidental ignition.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Referring to FIGS. 1-8, a first embodiment of the flamethrower is shown. It has features common to the second embodiment shown in FIGS. 9-10, wherein like numbers indicate like or similar parts. The first embodiment of the flamethrower is configured to be used as a separate unit, while the second form is configured to be used in combination with a supplemental carrying device, such as a firearm, but still being portable.

Figure 6:
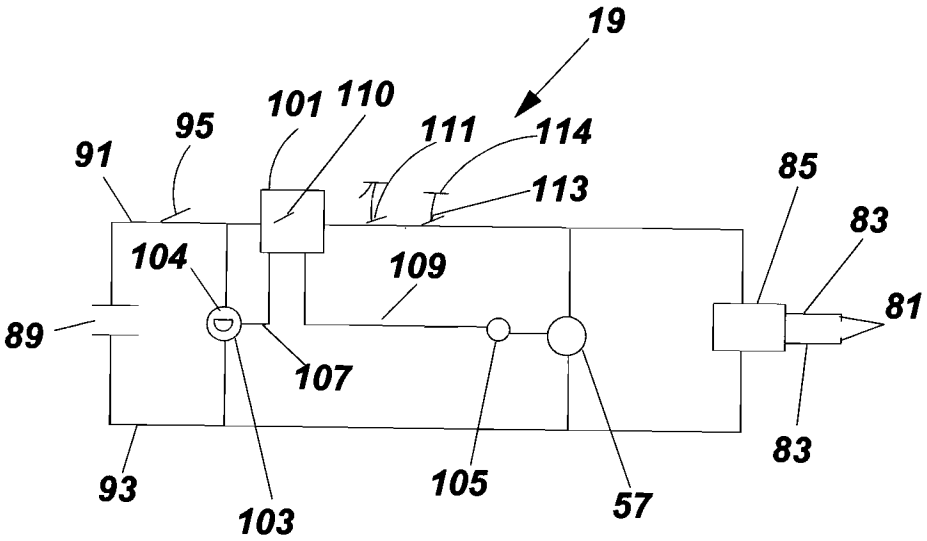
FIG. 6 is a schematic view of one embodiment of one electrical system suitable for use with the present device.
Figure 8:
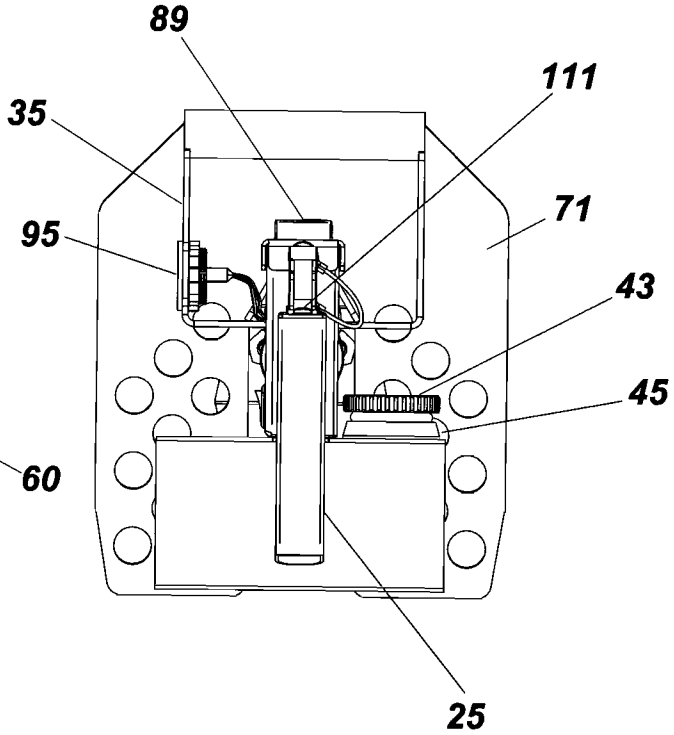
FIG. 8 is a rear elevation view of the flamethrower of FIGS. 1 and 2.

The reference numeral 11 designates generally a portable flamethrower that is adapted to be carried and operated as a separate unit by an individual. The flamethrower 11 comprises four basic components: means 13 for carrying and directing the flamethrower, fuel storage means 15, a fuel distribution system 17, and an operational control system 19 (FIG. 6).

In the illustrated structure, the means 13 includes a chassis 23 that includes a first handle 25, and preferably a second handle 27, and a forend 29 suitably secured together. In the illustrated embodiment, the first handle 25 is in the form of a pistol grip style handle. The second handle 27 is positioned forward of the first handle 25 and has a grip 31 that extends laterally across the chassis 23 and is preferably long enough to accommodate the full width of a user's hand. The grip 31 is mounted to other portions of the chassis 23 by mounting brackets 33, which in turn can be mounted to the forend 29. The forend 29 is positioned forwardly of the second handle 27, and the second handle 27 is forward of the first handle 25, and, as shown, carries additional components of the flamethrower 11 forward of an operator's hands. This allows for desirable weight distribution for balance. Positional terms as used herein are used in the context of the flamethrower being positioned in its normal use orientation, generally level. The above-described construction allows for both left-handed and right-handed use without modification of the flamethrower 11. In the illustrated structure, the chassis 23 also includes a housing 35 usable for purposes later described.

The fuel system includes both the fuel storage means 15 and fuel distribution system 17. In the illustrated structure, the fuel storage means 15 includes a fuel tank 41, which, in one embodiment, is mounted to and below the housing 35, and is adapted to store a quantity of flammable fuel that is preferably a carbon-based fuel. The tank 41 can also be a backpack style tank as described below, and is also connected in flow communication with the pump 51 described below. The tank types can be used separately or in combination. It has been found that gasoline is an acceptable fuel that can be used alone, and that can be combined with diesel fuel to form a mixed fuel that burns slower than gasoline alone. Gasoline has a lower flash point than diesel fuel, and is therefore easier to ignite with a spark or arc. To ignite, the fuel needs to provide fuel vapors to effectively initiate arc ignition. Other liquid fuels can also be used, such as but not limited to, alcohol, kerosene, oil and the like, so long as the fuel is suitable to ignite in response to the electronic igniter. The integrated fuel tank 41 preferably has a volume on the order of about 16 fluid ounces to about 64 fluid ounces, although other volumes can be utilized. A backpack style tank can have any suitable volume. Access is provided to the fuel tank 41 for filling, and possibly emptying, via a removable cap 43. The cap 43 is removably mounted to a filler neck 45, as by mutual threaded engagement. A seal 46 can be associated with either the neck 45 or cap 43 to prevent leakage therebetween. In order to effectively allow fuel to be withdrawn from the tank 41, a vent (not shown) can be provided for the tank. Such a vent can be part of the cap 43 and be in the form of a pressure actuated check valve, such as a flap valve. As shown, the neck 45 and cap 43 are positioned on top of the tank 41. The tank 41 is provided with an outlet 47 in flow communication with the interior of the tank, and positioned adjacent to the bottom of the tank 41, which allows flow connection between the tank 41 and a pump 51. This connection can be by a flexible hose or tube 53. While the fuel tank 41 is mounted to the chassis 23, preferably in a removable manner, an auxiliary tank, such as a backpack type tank 44, shown schematically in FIG. 1, can be used to provide fuel and can be in flow communication with the attached tank 41 via a flexible fuel line 48 or to the pump 51 by a direct connection.

In the illustrated embodiment, the pump 51 is mounted on the forend 29, as with suitable strap clamps 55. The pump 51 has an inlet 57 and an outlet 59. A preferred form of pump 51 is one that has little, if any, noticeable (in the external fuel flow stream) pulsating in its flow output. It is been found that a gear rotor or turbine type of pump that is electrically operated can be used. For example, the pump 51 can be a 12V pump that is suitable for battery operation. It has also been found that the pump 51 can have a maximum pressure output rating of between about 10 psi and about 150 psi. An automotive style fuel pump has been found effective, particularly the type utilized for fuel injection systems. The actual operating pressure of the pump 51 will be determined by the size of the orifice 68 (see FIG. 7) in the outlet nozzle 61 and the range of the stream of fuel desired. A round orifice with a diameter of about 0.072 inches has been found effective, although other sizes will work. The fuel nozzle preferably delivers a substantially laminar flow of the fuel when projected out of the nozzle 61 to help maintain fuel stream integrity. While a simple nozzle orifice can be round, other shapes can be used, such as oval and fan, so long as the output stream is maintained as an integral stream for a distance from the nozzle 61. Substantially laminar is defined as the preponderance of the fuel flowing in a cohesive stream with small droplets separating from the stream along the length of the stream as flaming beads. The nozzle 61 is coupled in flow communication with the pump 51 by a suitable flow conduit 64 for support, the conduit is preferably rigid. A check valve 66 can also be provided to prevent leakage and backflow. The pump 51 and orifice 68 in the nozzle 61 operate in combination to project a stream of fuel at least about 10 feet from the nozzle 61, and preferably to a distance of between about 10 feet and about 50 feet.

Figure 1:
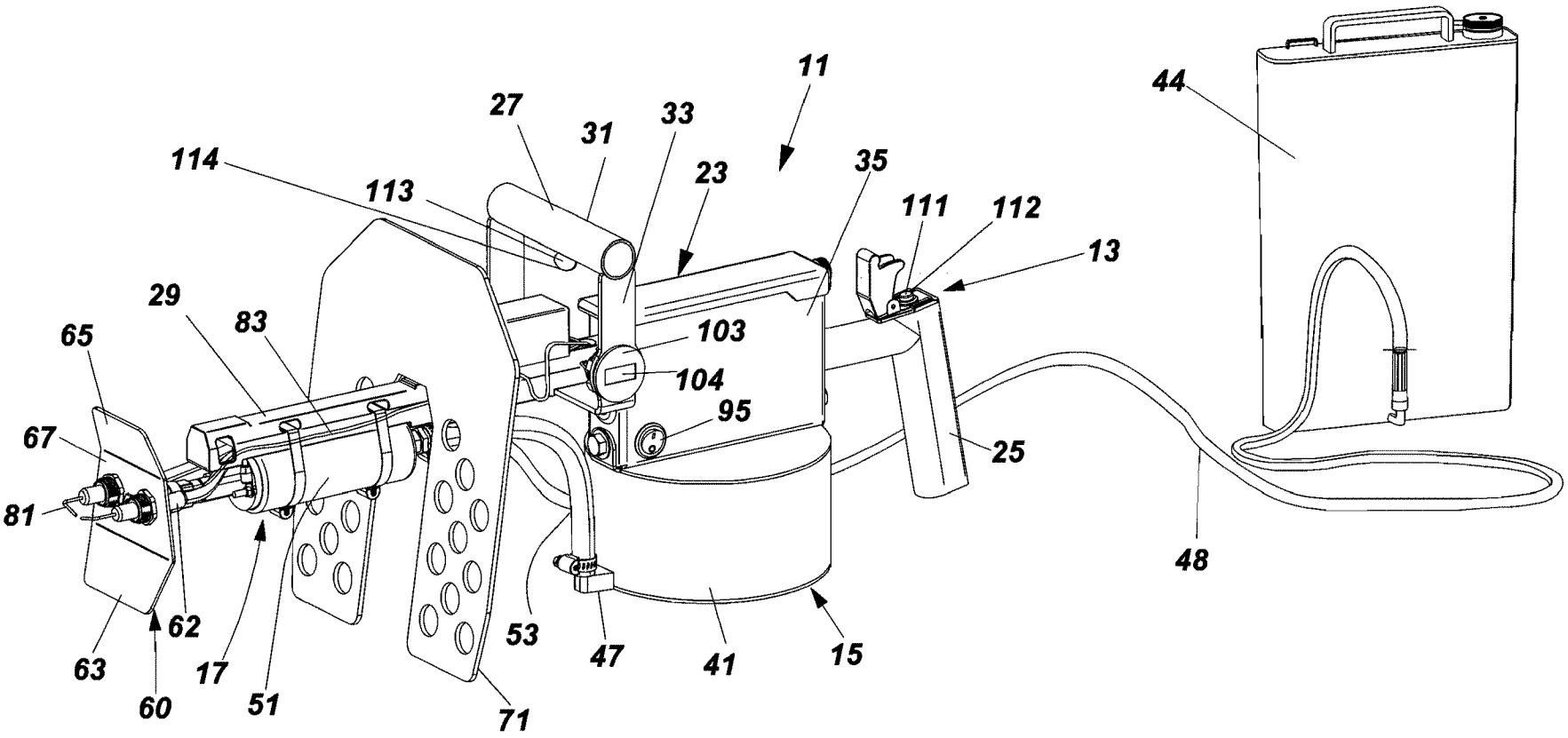
FIG. 1 is an isometric view of a first embodiment of a portable flamethrower.
Figure 2:
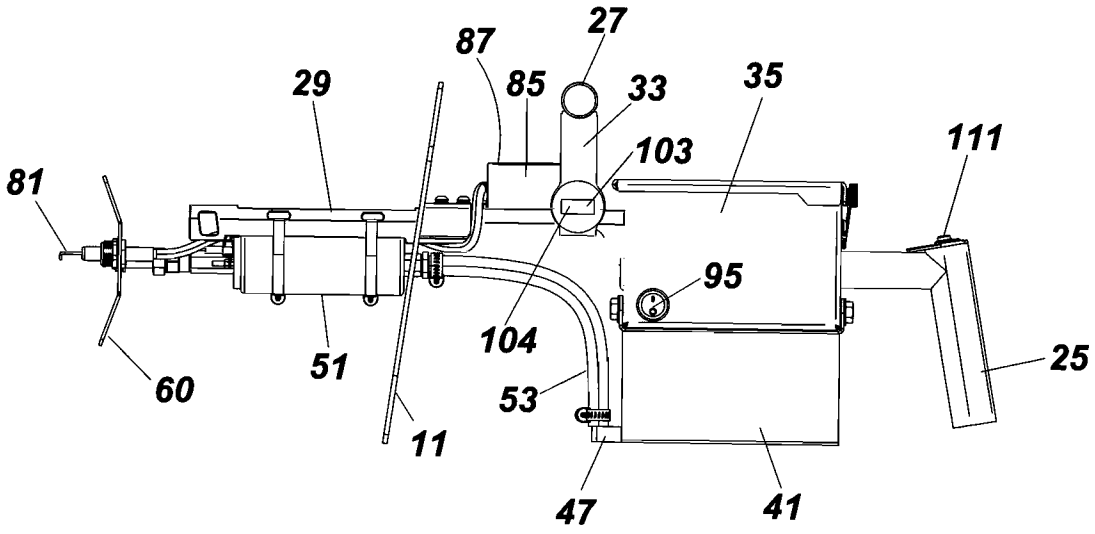
FIG. 2 is a side elevation view of the first form of portable flamethrower.
Figure 3:
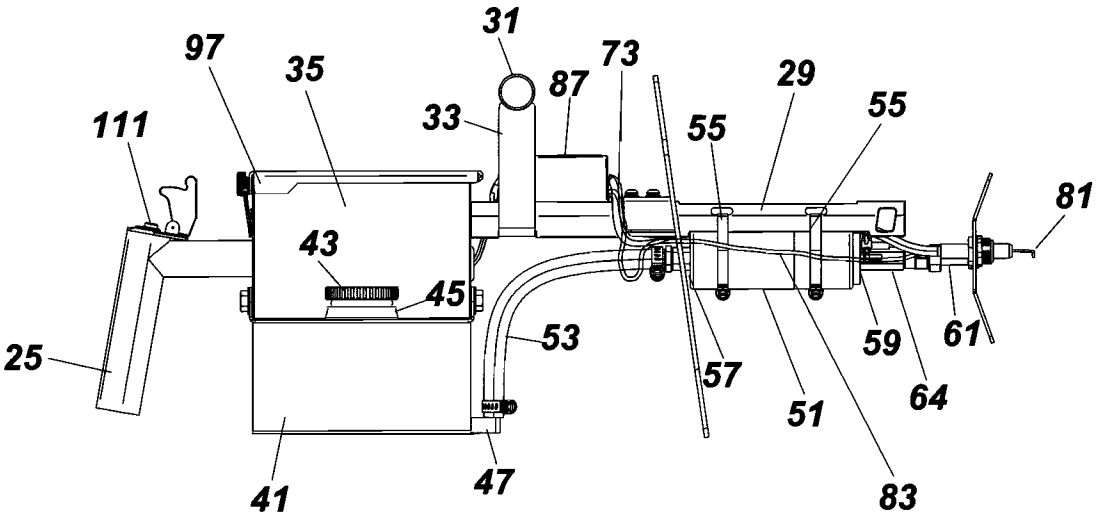
FIG. 3 is a side elevation view of the flamethrower of FIGS. 1 and 2, but viewed from the opposite side.

As seen in FIG. 1, the flamethrower 11 includes at least one first shield 60. The first shield 60 is in the form of a drip guard provided in a position between the outlet end of the nozzle 61 and the fuel pump 51. As shown, the shield 60 is mounted on the outlet nozzle 61 via a bracket 62. It has two end portions, 63, 65 connected by a central portion 67. The end portions 63, 65 incline forwardly of the central portion 67. In a preferred embodiment, the portions 63, 65 and 67 are each generally planar. A generally cone shaped shield 60 could also be used without departing from the scope of the invention.

A second shield 71 can also be provided. The second shield 71 is mounted to the chassis 23 forward of the tank 41 and handles 25, 27 via a bracket 73. The second shield 71 has a principal function of a heat shield. It is shown as a generally planar panel that extends outwardly from all sides of the chassis 23. Both of the shields 60, 71 are made of a non-flammable material, such as a low density metal like aluminum or aluminum alloy (herein, a metal name includes the metal alloys unless otherwise indicated). However, it should be noted that other materials including, but not limited to, steel, carbon fiber, ceramic or the like that are suitable to withstand heat from the nozzle area and flame of the flamethrower may be used.

Figure 7:
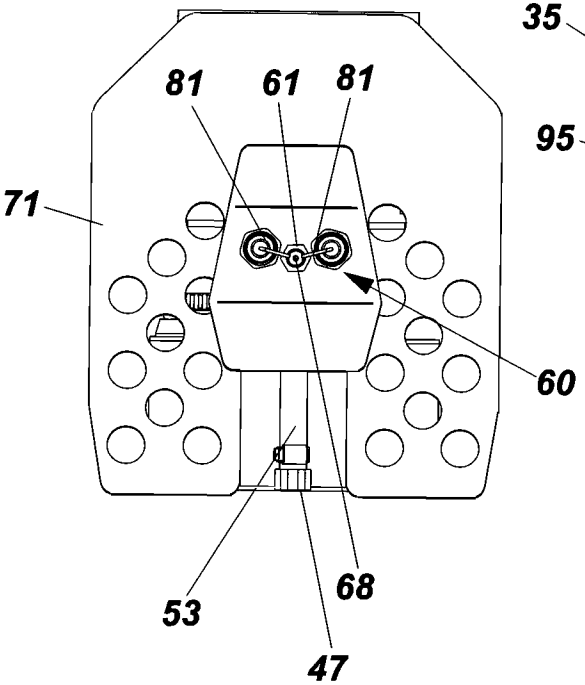
FIG. 7 is a front elevation view of the flamethrower of FIGS. 1 and 2.

The control system 19 is shown in FIG. 6. The control system 19 also includes means to selectively effect ignition of the fuel stream when flowing from the outlet nozzle 61. It is also operable to ensure that a battery will not be over discharged by not allowing use if the voltage is below a preset minimum voltage. In the illustrated embodiment, the ignition system includes a pair of electrodes 81, which are best seen in FIGS. 6, 1. The electrodes 81 are mounted so they are positioned forward of the outlet nozzle 61 and of the shields 60, 71. The spacing between the ends of the electrodes is such as to provide a gap of approximately 0.5 cm and about 1.0 cm. Thus, a voltage of approximately 15,000 to 30,000 V can easily arc between the ends of the two electrodes 81. It has been found that a 16,500 V arc is adequate. The electrodes 81 are insulated adequately from the remainder of the flamethrower 11 to prevent current flowing to any portion of the flamethrower that contacts a user. As seen in FIG. 7, the ends of the electrodes 81 are positioned such that the orifice 68 is approximately centered between the free ends of the two electrodes 81 and below the electrodes so that the stream of fuel is close, but not directed through an arc that will be projected between the two electrodes 81. The arc between the electrodes 81 should be sufficiently close to the projected stream to ignite it. It is also preferred that the leads 83 and electrical conductors are also electrically insulated. The leads 83 connect the electrodes 81 to a high-voltage source 85, such as a transformer 87. The high-voltage source 85 is connected to a power source 89 by electrical leads 91, 93. The so-called hot lead 91 is connected directly to the power source 89, while the other lead 93 connects to the power source 89 through control elements described below. As shown, the high-voltage source 85 is mounted on the chassis 23 rearward of the shield 71, but could be mounted in any other suitable location. Also, the power source 89 can be mounted inside the housing 35 or any other suitable location. The housing 35 can include a removable access door 97 to provide for access to the power source 89.

The power source 89 is connected between the leads 91, 93 via a power on switch 95. The power source (not shown) is preferably a rechargeable battery pack, such as the type utilized for power tools, and may snap into and out of the flamethrower to allow for quick replacement. In a preferred embodiment, the battery pack is a lithium ion battery pack that includes voltage between about 12 volts and 24 volts. An electronic controller 101 is provided and is actuated by the power on switch 95; it is positioned electrically between the battery(ies) and the power on switch 95. Preferably, the switch 95 is of the latching type. The illustrated controller 101 is a simplified form to illustrate operability. As shown, the controller 101, once the power on switch 95 is activated, will remain on until the switch 95 is off. The controller 101 is also electrically connected to automatically operating safety units, such as a voltmeter 103. An optional pressure sensor 105 is also illustrated. The safety units are connected to the controller 101 by suitable connections, such as hard-wiring 107 and 109 respectively. The voltmeter 103 can be provided with a digital readout 104 for the convenience that can indicate, numerically or graphically, the battery condition. In operation, when the circuit is powered on by closing of the switch 95, the voltmeter 103 will provide a signal to the controller 101 and, if the voltage is below a preset minimum, the controller 101, through a switching device 110, will not power the pump 51. It will also prevent energizing the high-voltage source 85 to prevent both fuel flow and arcing. An additional feature of the present invention is the use of a pressure sensor 105 that, if a predetermined pressure is not sensed, for example, the flamethrower 11 is out of fuel, then the controller 101 will not allow continued energizing of the pump 51 and the high voltage source 85.

If the controller 101 determines the system is not ready for operation by sensing at least a preset minimum voltage from the voltmeter 103, the controller 101 will not allow either the pump 51 or the high-voltage source 85 to be actuated and operate. If the voltage and pressure are adequate, then the high voltage source 85 and the pump 51 will continue to be energized. It is to be understood that the controller 101 can provide a time delay to wait for a pressure reading from the pressure sensor 105 and, if the pressure is adequate, indicating available fuel, then the arc can be initiated by powering the high-voltage source 85. If the pressure sensor 105 does not indicate adequate pressure, then the control system 101 cannot be entirely actuated. At least one activation switch is provided to allow current flow from the switch 95 through the controller 101 to power both the pump 51 and the high-voltage source 85. As shown, a pair of switches, 111 and 113, are wired in series between the controller 101 and the pump 51 and high-voltage source 85. Preferably, the switches 111 and 113 are of the momentary type. The trigger switch 111 can be mounted on the handle 25, while the switch 113 can be mounted on the second handle 27. The use of a plurality of switches 111, 113 provides an interlock needing two hands to operate. As shown, the switch 111 has a switch operator portion 112 and the switch 113 also has a switch operator portion 114 for engagement by an operator, as with a hand digit like a thumb or finger.

Figure 4:
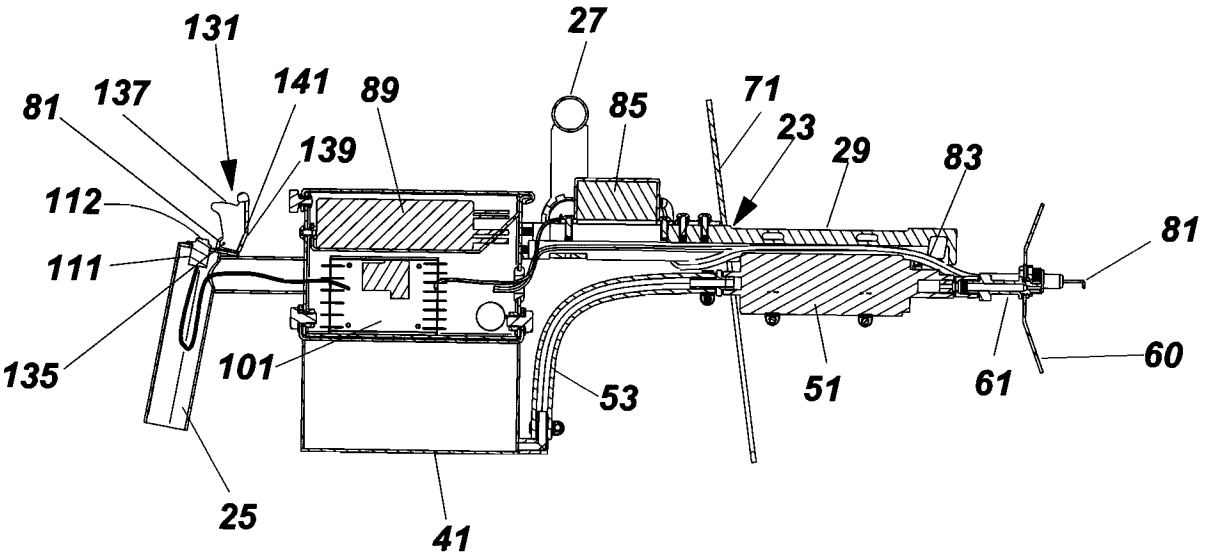
FIG. 4 is a fragmentary side elevation view of the flamethrower of FIGS. 1 and 2 with a portion broken away to show internal details.
Figure 5:
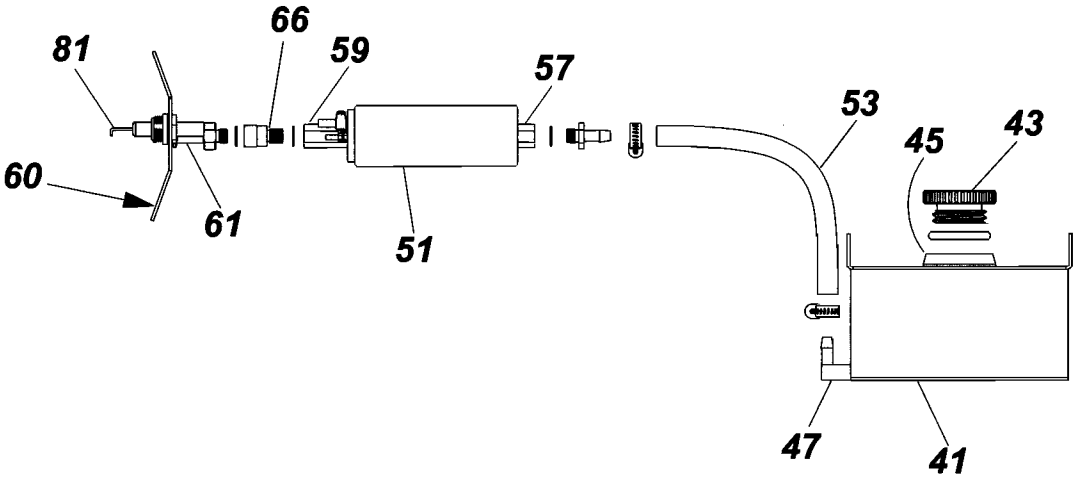
FIG. 5 is an exploded view of the fuel supply components of the flamethrower of FIGS. 1 and 2.

The flamethrower 11, as seen in FIG. 4 and not in the other figures, is provided with an interlock to reduce the chance of unintentionally contacting the switch 111 without a ready to operate operator movement. As shown, a cover 131 is movably mounted to the chassis 23, preferably at the handle 25 of the chassis. The cover 131 is shown as being pivotally mounted at 133 to the handle 25 forward of the switch operator 112 on a stanchion 135. The cover 131 includes spaced apart side portions 137 connected (only one is shown) by a linking portion 139 that overlies the switch operator 112 and is spaced therefrom. The forward edge 141 of the linking portion 139 will engage the handle 25 or other portion of the chassis 23 to limit forward movement of the cover 131 to a position that will allow gravity to move the cover to its closed position, as seen in FIG. 4, to preclude contact with the switch operator 112. The cover 131 can be selectively pivoted to a forward position to allow a user access to the switch operator 112 for activation.

Figure 9:
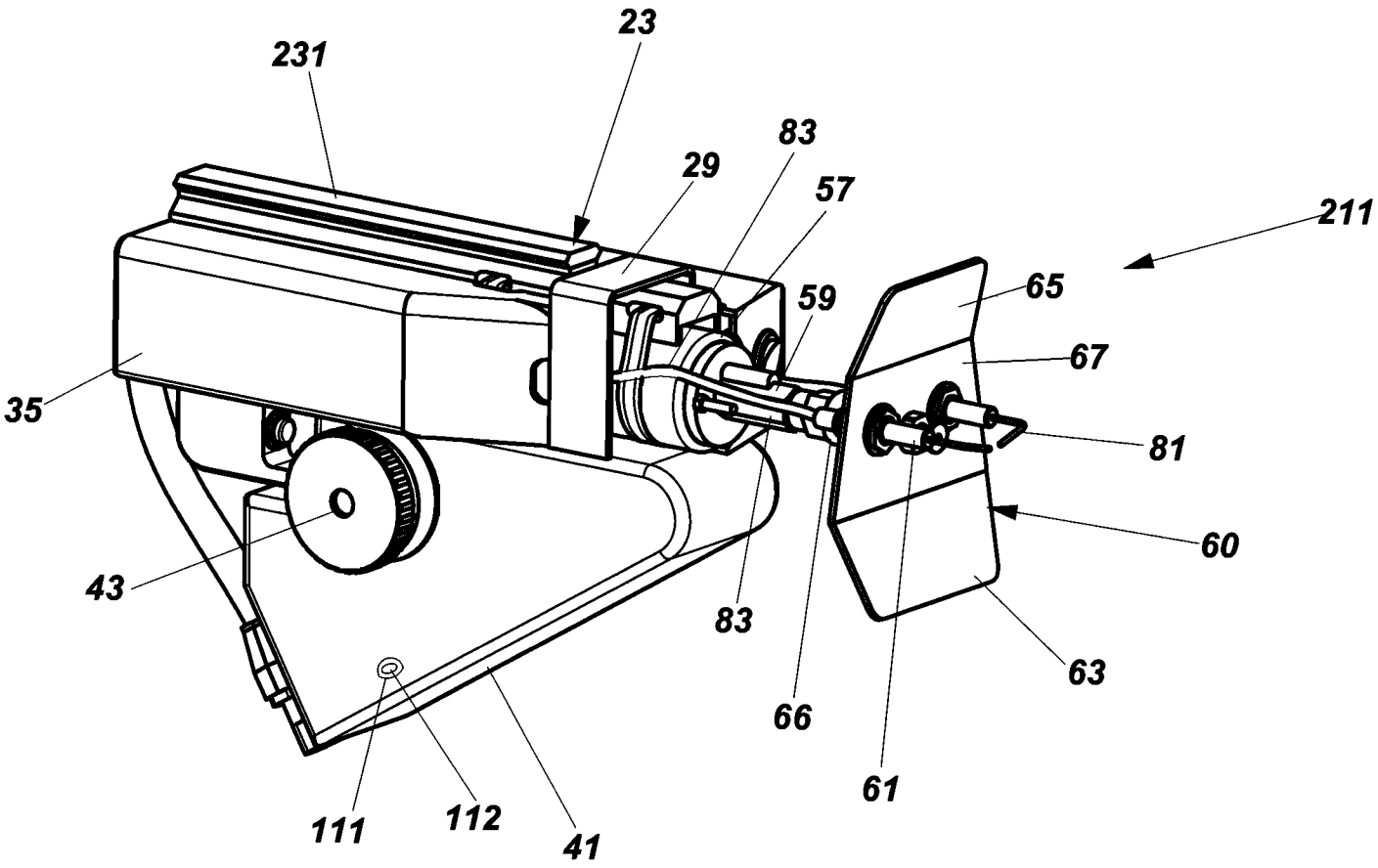
FIG. 9 is an isometric view of a second embodiment of the invention.
Figure 10:
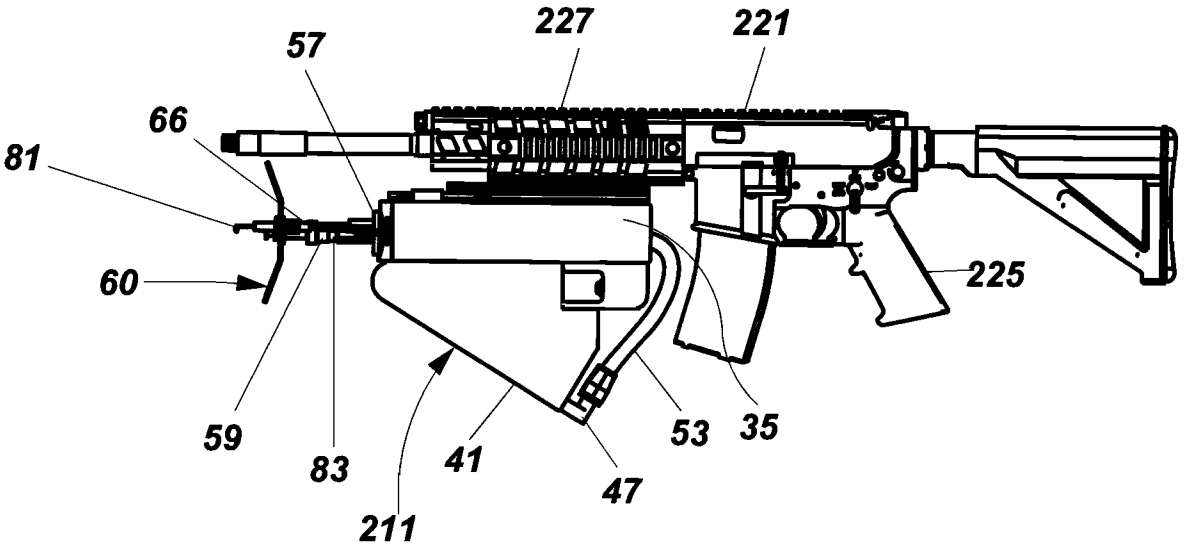
FIG. 10 is a side elevation view of the embodiment shown in FIG. 9.

FIGS. 9 and 10 illustrate a second embodiment of the invention. It is similar to the first embodiment, where like numbers designate like or similar parts or construction. The reference numeral 211 generally designates the second embodiment of flamethrower. The flamethrower 211 comprises four basic components, a means 13 for carrying and directing the flamethrower, fuel storage means 15, a fuel distribution system 17, and an operational control system 19 (FIG. 6).

In the illustrated structure, the means 13 includes a chassis, designated generally 23, that includes a forend 29.

In the illustrated embodiment, the handles 25, 27 are replaced by a carrier, such as an AR style rifle 221, wherein the handle 25 is replaced by the handle (pistol grip) 225, and the second handle 27 is replaced by the hand guard or forearm 227. The flamethrower 211 is suitably mounted to the firearm 221, as by being releasably secured to the forearm 227 and positioned there beneath for use. The flamethrower 211 can be mounted to the forearm 227 using any suitable means, such as the so called M-Lok system or an accessory rail mounted to the forearm 227. As shown, the flamethrower 211 is provided with an elongate mounting rail 231 that permits mounting for longitudinal adjustment of its position along the length of the firearm 221. This allows for desirable weight distribution for balance.

In the illustrated embodiment of the flamethrower 211, the power source 89, controller 101 and high-voltage source 85 are mounted inside of the housing 35. The structure and operation, other than noted above, is similar in construction and operation to the flamethrower 11 described above. A switch 111 and switch operator 112 can be suitably mounted to the flamethrower 211 or firearm 221 at a desired location, for example on the chassis 23 or near the handle 225 or the forearm 227.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A portable flamethrower for use and transport by an individual, the flamethrower including:

a chassis;

an electrical power source;

a tank, the tank being adapted to hold a quantity of liquid fuel, said tank having a fuel inlet and a fuel outlet;

a nozzle mounted to the chassis and in flow communication with the tank;

a pump connected to the fuel outlet and the nozzle and operable to effect fuel flow from the tank to the nozzle, said pump being connected to the power source for receiving energy therefrom to effect operation of the pump;

a control system for monitoring the electrical power source;

at least one activation switch electrically connected between the power source and the pump and operable to selectively effect operation of the pump, said activation switch having a switch operator positioned for access by a user of the flamethrower;

a first shield mounted to the chassis adjacent the nozzle;

a high voltage source mounted to the chassis and electrically connected to at least one activation switch and being operable to selectively connect the high voltage source to the power source;

at least two spark igniter electrodes mounted to the chassis adjacent the nozzle and positioned in spaced apart relationship, providing an arc path therebetween, said electrodes being connected to the high voltage source to selectively effect an electrical arc between the electrodes, said electrodes being positioned such that fuel vapor from a stream of fuel from the nozzle will pass through an arc between the electrodes, said electrodes being electrically insulated from the chassis;

wherein, the control system is operable to determine if the voltage provided by the electrical power source is above a preset minimum before connecting the electrical power source to at least one of the pump or the high voltage source.

2. The flamethrower of claim 1 wherein the activation switch being operable to substantially simultaneously effect operation of the pump and the high voltage source.

3. The flamethrower of claim 1 including a cover movably mounted on the chassis adjacent said switch operator and being biased to a switch operator covering position when the flamethrower is in a position for use by an operator.

4. The flamethrower of claim 2, wherein there being a pair of activation switches each having a switch operator, said switches being electrically connected in series between the power source and the pump and the high voltage source, wherein both activation switches are closed to effect a circuit between the power source and the pump and high voltage source.

5. The flamethrower of claim 4, wherein the pair of activation switches having their switch operators spaced apart sufficiently such that an operator needs to use two hands to close the activation switches.

6. The flamethrower of claim 4 including a power on switch electrically connected between the power source and the pump and high voltage source.

7. The flamethrower of claim 6 wherein the power on switch being electrically connected between the power source and one of the activation switches.

8. The flamethrower of claim 1 wherein the control system includes a voltage sensor operably associated with the power source and being operable to open a circuit between the power source and the pump if a preset minimum voltage from the power source is not available, preventing the pump from being energized.

9. The flamethrower of claim 1, wherein the tank being mounted to the chassis.

10. The flamethrower of claim 1, wherein the tank being a backpack tank and being in flow communication with said pump.

11. The flamethrower of claim 4, wherein the chassis including a pair of hand engageable handles each having a respective said activation switch operator mounted thereto.

12. The flamethrower of claim 1, wherein the chassis being configured for mounting to a firearm.

13. The flamethrower of claim 1, wherein the power source including a battery and the power source being mounted to the chassis.

14. The flamethrower of claim 1 including a second shield mounted to the chassis rearward of the first shield.

15. The flamethrower of claim 1, wherein the nozzle includes a check valve to prevent leakage of fuel through the nozzle and prevent backflow of fuel to the pump and tank.

16. The flamethrower of claim 1 wherein the control system includes a voltage sensor operably associated with the power source and being operable to open a circuit between the power source and the high voltage source if a preset minimum voltage from the power source is not available, preventing the high voltage source from being energized.

* * * * *